US007051841B1

(12) United States Patent
Kasbergen et al.

(10) Patent No.: US 7,051,841 B1
(45) Date of Patent: May 30, 2006

(54) STAIRLIFT

(75) Inventors: Paulus Kasbergen, Capelle a/d Ijssel (NL); Willem Heijns, Alblasserdam (NL); Eduard Jozef Marie Duynstee, Ouderkerk a/d Ijssel (NL)

(73) Assignee: Thyssen deReus B.V., Ijssel (NL)

( * ) Notice: Subject to any disclaimer, the term of this patent is extended or adjusted under 35 U.S.C. 154(b) by 0 days.

(21) Appl. No.: 09/581,292

(22) PCT Filed: Dec. 10, 1998

(86) PCT No.: PCT/NL98/00709

§ 371 (c)(1),
(2), (4) Date: Aug. 18, 2000

(87) PCT Pub. No.: WO99/29611

PCT Pub. Date: Jun. 17, 1999

(30) Foreign Application Priority Data

Dec. 11, 1997 (NL) ..... 1007770

(51) Int. Cl.
*B66B 9/08* (2006.01)

(52) U.S. Cl. ..... 187/201

(58) Field of Classification Search ..... 187/200, 187/201, 202

See application file for complete search history.

(56) References Cited

U.S. PATENT DOCUMENTS 5,720,364 A 2/1998 Glover ..... 187/201

FOREIGN PATENT DOCUMENTS

| | | | |
|---|---|---|---|
| GB | 2 301 811 | | 12/1996 |
| WO | WO 95/18763 | | 7/1995 |
| WO | WO 95/29867 | | 11/1995 |
| WO | 98/37007 | * | 8/1998 |
| WO | 99/46198 | * | 9/1999 |

* cited by examiner

*Primary Examiner*—Thomas J. Brahan
(74) *Attorney, Agent, or Firm*—Merchant & Gould P.C.

(57) ABSTRACT

There is described a stairlift (1), comprising: a carriage (3) displaceable along a bent path, and a chair (5) carried by said carriage (3) and mounted on said carriage (3) for tilting about a horizontal axis of rotation (11); a horizontal-keeping mechanism (100) for keeping the chair (5) upright, comprising: an angle sensor (110) providing a signal (S(θ)) indicative of the instantaneous value of an angle of rotation (θ) between the chair (5) and the carriage (3); an orientation sensor (130) associated with the carriage (3) and providing a signal indicative of variations in the position (ϕ) of the carriage (3); and an absolute-orientation sensor (140) associated with the chair (5), providing a signal (S(ψ) representative of the instantaneous value of the position (ψ) of the chair (5). The control members (101, 102) control said angle of rotation (θ) on the basis of the signals (S(ϕ), S(ψ) received.

8 Claims, 2 Drawing Sheets

STAIRLIFT

The present invention generally relates to a lift, for instance a stairlift, such as a chair stairlift or a wheelchair stairlift, comprising:

- a carriage which is displaceable along a path of which a projection on a vertical plane contains at least one bend;
- a drive mechanism having a drive motor for displacing the carriage along said path;
- an object such as a chair or a platform, carried by said carriage and mounted on said carriage for tilting about a substantially horizontal axis of rotation;
- a horizontal-keeping mechanism for holding the object in a predetermined position relative to the vertical, said horizontal-keeping mechanism comprising:
  - a rotation mechanism, driven by a motor, for causing said object to tilt relative to said carriage;
  - an orientation sensor coupled associated with the carriage, providing a signal ($S(\phi)$; $S(\partial\phi/\partial t)$) indicative of variations in the position ($\phi$) of the carriage in respect of said axis of rotation relative to the vertical;

Such a lift is known from GB-A-2301811.

Hereinafter, the term "stairlift" will generally be used for a transport installation whereby, for instance, people who walk with difficulty and, consequently, are not capable of using the stairs, are enabled to ascend or descend that stairway as yet. Hence, a stairlift generally comprises a carriage and displacement means for displacing that carriage along the steps of a stairway. On that carriage, a chair can be mounted. A person sitting on that chair can ascend or descend the stairway in that the carriage moves up or down. During the path to be travelled, the orientation of the carriage varies in space. However, it will be understood that the chair must be held upright throughout the path, i.e. the siting portion of the chair must be held substantially horizontal. Therefore, a stairlift of the above-mentioned type as known from GB-A-2301811 is provided with sensor- and actuator means for keeping the chair in a predetermined position relative to the vertical, which means will hereinafter be referred to as a 'horizontal-keeping mechanisms'.

It will be understood by anyone skilled in the art that comparable requirements are imposed on, for instance, a wheelchair lift: in a wheelchair lift, a platform on which a wheelchair will rest must be held horizontal.

By way of example, reference is made to EP-0.436.103. This publication describes a carriage which, by means of caterpillar tracks, is capable of climbing the steps of a stairway or a different kind of slope. In particular at the beginning and at the end of the stairway, the incline of the carriage varies. On that carriage, a chair is mounted. In accordance with a program inputted in a memory, the incline of the chair is controlled so that the center of gravity of the carriage is displace to prevent the carriage from falling over.

Dutch patent 10.01327, to applicant, describes a stairlift comprising a guide rail that can be mounted along an existing stairway in, for instance, a house. A carriage can travel along that rail. Along the path of the stairway, the incline of the rail varies, and, accordingly, the orientation of the carriage varies in space. Mounted on that carriage is a chair which is to be held upright. However, this publication does not provide any details concerning the necessary horizontal-keeping mechanism.

Conventionally, the problem of keeping a chair upright when a carriage is to displaced along a guide rail is solved in that along and parallel to said guide rail, a second rail, to be referred to as orienting rail, is provided, and the carriage comprises a lever coupled to the orienting rail, which lever operates a horizontal-keeping mechanism in a mechanical manner. The shape of the orienting rail is adapted to the shape of the guide rail so that in any position along the guide rail, the lever coupled to the orienting rail keeps the chair in upright position. A drawback of such conventional method, however, is that a second rail is required, whose shape is to be adjusted on the site of each individual installation.

To overcome this drawback, international patent application WO 95/18763 describes a stairlift whose horizontal-keeping mechanism comprises a tilting mechanism operable by an electric motor, and a control unit for the motor. The control unit comprises a memory storing a relationship between the position of the carriage along the rail on the one hand, and the desired orientation of the chair relative to the carriage on the other. The control unit obtains information concerning the current position along the rail, for instance by monitoring the revolutions of the motor. On the basis of this position information, and on the basis of said relationship, the control unit sets a specific orientation of the chair relative to the carriage.

However, this installation, too, has the drawback that the information stored in the memory exclusively relates to a single, individual installation, while the relevant, memory-stored information is to be determined on the site, for which purpose the publication describes a programming session before the installation is put into operation. In this regard, it is a drawback that the memory has only a limited number of locations, to that the relationship is only defined for a limited number of positions along the rail and the position of the chair in intermediate positions must be determined by interpolation.

A further drawback is that the position of the chair is in each case set as a predetermined orientation relative to the carriage. However, it is not checked whether the chair is actually upright, as a result of which this known installation is not completely safe.

The object of the present invention is to provide a lift which does not have the above drawbacks.

More in particular, the object of the present invention is to provide a stairlift in respect of which, at least for the chair adjustment, it is not necessary to read in an electronic memory or adjust a mechanical memory at the location of the installation.

It is a further object of the present invention to provide a stairlift whose safety is increased, in that regardless of the position of the carriage and regardless of the orientation of the carriage, the orientation of the chair relative to the carriage can at all times be controlled so that the chair is upright in space.

To that end, in accordance with an important aspect of the present invention, the lift as described in the opening paragraph in characterised in that the horizontal-keeping mechanism further comprises:

- control members for said motor, the orientation sensor being coupled to the control members;
- an angle sensor coupled to the control members and providing a signal ($S(\theta)$) indicative of the instantaneous value of an angle of rotation ($\theta$) between the object and the carriage;
- wherein the control members are arranged to drive the motor so that said angle of rotation ($\theta$) is changed to an equal extent but opposite to the variations in the position ($\phi$) of the carriage detected by the orientation sensor.

These and other aspect, characteristics and advantages of the present invention will be clarified by the following description of a preferred embodiment of a stairlift according to the invention, with reference to the accompanying drawings. In these drawings.

Figure 3:
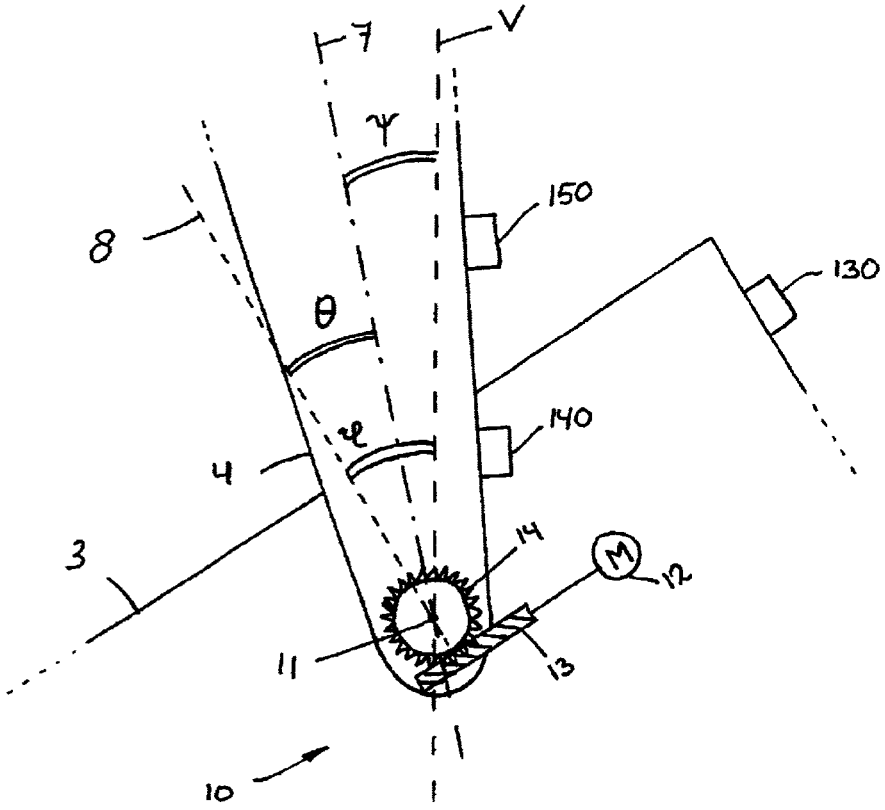
Figure 4:
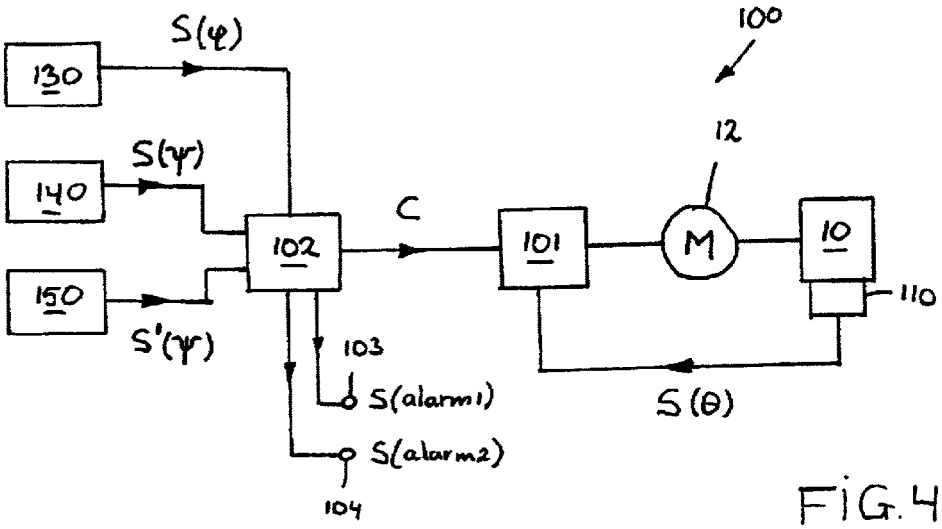

FIG. 3 schematically shows some details of a stairlift according to the present invention; and FIG. 4 schematically shows a block diagram of a horizontal-keeping mechanism.

Figure 1:
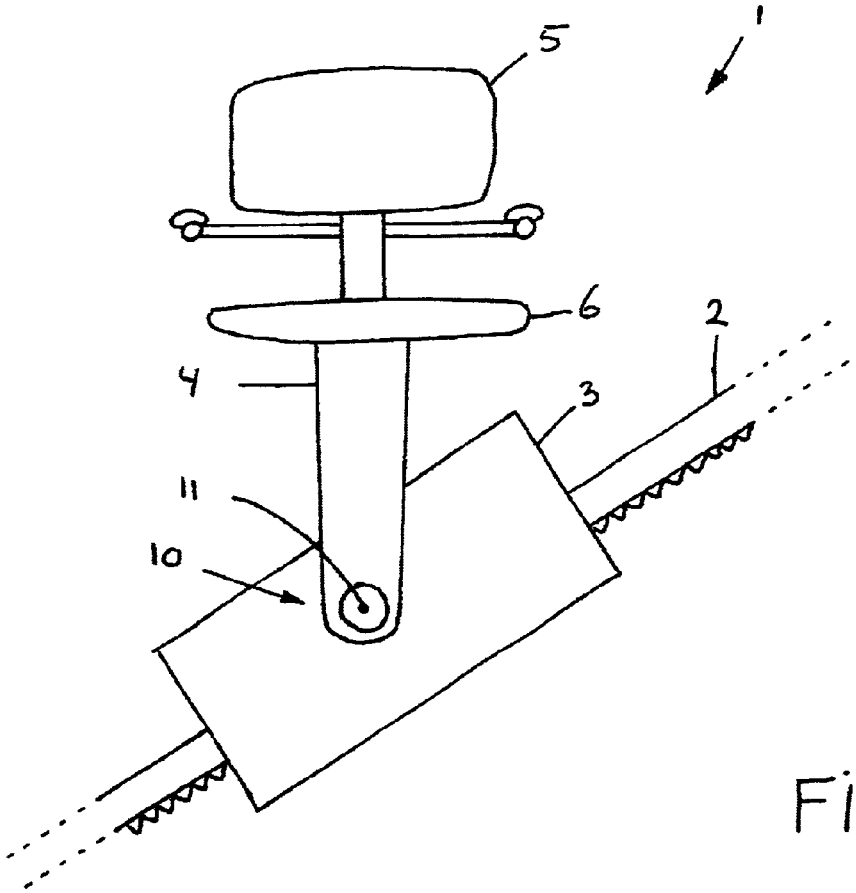
FIG. 1 is a schematic side elevation of a portion of a stairlift construction.

FIG. 1 schematically shows some parts of a stairlift 1 according to the present invention, generally denoted by reference numeral 1. The stairlift 1 comprises a rail 2 mounted along a stairway T (FIG. 2), for instance against a wall. A carriage 3 is displaceable along the rail 2, to which end the carriage 3 comprises a drive mechanism with a drive motor, not separately shown for the sake of simplicity. As the nature and construction of the rail 2 and the carriage 3 do not constitute a subject of the present invention, and a skilled person need not have any knowledge thereof for a proper understanding of the present invention, while, further, use can be made of constructions known per se, they will not be further described. By way of example, the rail may be provided with a gear rack and the motor operates a gear wheel engaging said gear rack, as described in WO 95/18763. Preferably, however, the rail has a circular cross section, and the drive mechanism has the construction as described in NL-10.01327.

Mounted on the carriage 3 is a chair support 4 carrying a chair 5. Via a rotation mechanism 10, shown only schematically, the chair support 4 is coupled to the carriage 3, which rotation mechanism 10 defines an axis of rotation 11 directed substantially horizontally, in FIG. 1 perpendicular to the plane of the drawing. By virtue of the rotation mechanism 10, the chair support 4 can rotate relative to the carriage 3 about said axis of rotation 11.

The rotation mechanism 10 can be any suitable mechanism, as will be understood by anyone skilled in the art, and will therefore not be further explained. It suffices to observe that the rotation mechanism 10 comprises an electromotor 12 for adjusting the support 4. For safety reasons, the rotation mechanism 10 is preferably self-braking, which means that in the event of failure of the motor 12, the chair 5 cannot fall over; in a possible embodiment, this characteristic feature is achieved in that the rotation mechanism 10 comprises a worm/wormwheel transmission 13/14 (see FIG. 3), as is known per se.

Figure 2:
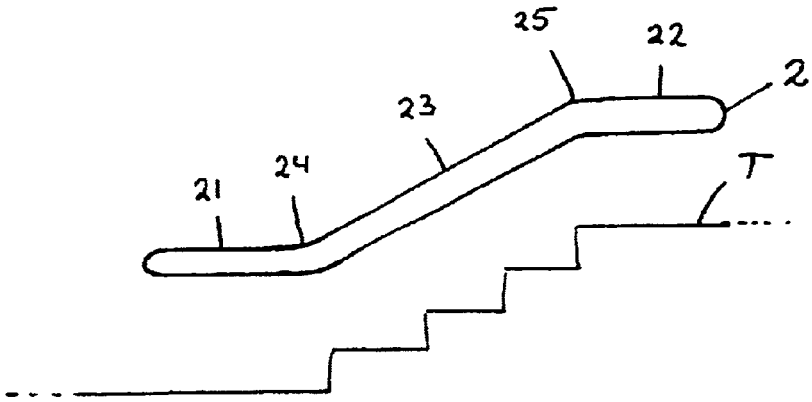
FIG. 2 is a schematic side elevation of a stairway having a stairlift.

FIG. 2 illustrates a simple situation of a stairway T consisting of a number of steps. The stairway T can be a simple, straight stairway, in which case FIG. 2 can be regarded as a side elevation, but the stairway T can also have a horizontal bend (about a vertical axis), in which case FIG. 2 can be regarded as a horizontal projection on a vertical, curved plane. FIG. 2 clearly shows that the incline of the rail 2 varies along the length thereof: at the ends 21 and 22 the rail 2 is horizontal, at a central portion 23 the rail 2 has a constant incline, and at the transitional parts 24 and 25 the rail 2 is curved in vertical direction, i.e.; the rail 2 has a bend portion bent about a horizontal axis, with the incline of the rail changing continuously. In FIG. 1 it is sketched that the orientation of the carriage 3 corresponds to the incline of the rail 2. In other words: when the carriage 3 moves along the rail 2, its orientation will change. The rotation mechanism 10 serves for setting an angle of rotation θ of the chair support 4 relative to the carriage 3 in such a manner that the chair 5 is always kept upright in space, i.e. the seat 6 of the chair 5 is in each case held substantially horizontal, regardless of the incline of the rail 2.

As described in the introduction, known systems require a reference to the fixed world for setting an angle of rotation of the chair support 4, such as, for instance, information concerning the instantaneous position along the rail 2.

Presently, a preferred embodiment of a horizontal-keeping mechanism 100 according to the present invention will be discussed with reference to FIGS. 3 and 4. FIG. 3 schematically shows, to a larger scale than FIG. 1 for clarity's sake, a part of the carriage 3 and the chair support 4. In the following discussion, the chair support 4 is drawn with an exaggerated inclination, for the sake of illustration. A center line of the chair support 4 is designated by reference numeral 7; the absolute vertical is designated by V. The angle between the center line 7 and the vertical V is designated by ψ. In the ideal case, when the chair 5 is upright, i.e. the seat 6 is horizontal, at least symmetrical relative to the vertical V, ψ is 0°.

Reference numeral 8 designates a reference line associated with the carriage 3. This auxiliary line 8 is vertically directed when the carriage 3 is horizontally directed, i.e. when the carriage 3 is located entirely on a horizontal portion 21, 22 of the rail 2. When the carriage 3 is at an inclined portion 23, 24, 25 of the path 2, the carriage 3 is inclined over a specific angle, which angle is defined as the angle ϕ between the reference line 8 and the vertical V.

The position of the chair support 4 relative to the carriage 3 is characterized by the angle θ between the reference line 8 of the carriage 3 and the center line 7 of the chair support 4. When the chair 5 is upright and the carriage 3 is located entirely on a horizontal portion 21, 22 of the rail 2, this angle θ equals 0°.

As appears from FIG. 3, in the example shown, it applies that $\psi=\phi-\theta$.

The horizontal-keeping mechanism 100 comprises a first control member 101 which controls the exciting current I for the motor 12 in such a manner that a specific value of the angle of rotation θ of the chair support 4 relative to the carriage 3 is kept constant. To that end, the horizontal-keeping mechanism 100 comprises an angle sensor 110 coupled between the chair support 4 and the carriage 3 for providing a signal S(θ) to the first control member 101 which signal is indicative of the instantaneous value of the angle of rotation θ.

The first control member 101 can for instance be a suitably programmed microprocessor or controller. In a simple embodiment, the first control member 101 can be a differential amplifier which receives the signal S(θ) on its inverting input.

The angle sensor 110 can be any suitable sensor or transducer known per se. In a possible embodiment, this angle sensor 110 comprises an encoder coupled to a driven shaft of the rotation mechanism 10, which encoder can for instance be a segmented disk, as is known per se.

The horizontal-keeping mechanism 100 comprises a second control member 102, for instance a suitably programmed microprocessor or controller, providing a command signal C to the first control member 101. The first control member 101 controls the motor 12 on the basis of the command signal C. The command signal C can be directly indicative of a desired angle of rotation θ; in that case, the first control member 101 controls the motor 12 so that the measuring signal S(θ) received from the angle sensor 110 corresponds to the command signal C. Alternatively, the command signal C can be indicative of a desired change Δθ of that angle of rotation; in that case, the first control member 101 controls the motor 12 so that the command signal C becomes zero. Alternatively, the command signal C can be a ternary signal, representing either the command "increase θ", or the command "decrease θ", or the command "maintain θ"; in that case, the first control member 101 controls the motor 12 in accordance with the command received.

In accordance with an important feature of the present invention, the horizontal-keeping mechanism 100 comprises an orientation sensor 130 associated with the carriage 3. The orientation sensor 130 is sensitive to variations in the position of the carriage 3, i.e. variations in the angle ϕ between the reference line 8 on the carriage 3 and the vertical V, measured in the plane perpendicular to the axis of rotation 11. The orientation sensor 130 can provide a signal S(ϕ) to the second control member 102 which signal is indicative of the instantaneous value of said angle ϕ. It is possible that the signal S(ϕ) in an absolute sense represents the value of ϕ, but that is not required: it is sufficient when S(ϕ) substantially has a constant value if ϕ does not vary. This means that that signal S(ϕ) represents the instantaneous value of said angle ϕ except for a constant value; this "constant value", however, need not be absolutely constant, but may slowly vary (drift) in time. The above implies that no strict requirements are imposed on the orientation sensor 130 in the sense of absolute accuracy; however, the orientation sensor 130 is required to react relatively quickly and accurately to changes of said angle ϕ.

The signal S(ϕ) from the orientation sensor 130 is provided as input signal to the second control member 102. The second control member 102 generates the command signal C for the first control member on the basis of the input signal S(ϕ) received, in such a manner that θ is changed equally yet opposite to a change of ϕ. The effect thus achieved is that the orientation of the chair 5 in space is kept constant upon variation of the orientation of the carriage 3.

As the operation and construction of the orientation sensor 130 do not constitute a subject of the present invention, and any knowledge thereof is not required for a proper understanding of the present invention, this sensor will not be further discussed. It suffices to observe that such sensors are known per se, for instance in the form of a gyroscope, and that such sensors can be utilized.

In accordance with a further important feature of the present invention, the horizontal-keeping mechanism 100 comprises an absolute-orientation sensor 140 associated with the chair support 4. The orientation sensor 140 is sensitive to the rotational position of the chair support 4 relative to the axis of rotation 11, measured in the plane perpendicular to the axis of rotation 11. The absolute-orientation sensor 140 can provide a signal S(ψ) to the second control member 102, which signal is representative of the instantaneous absolute value of said angle ψ, which value represents the difference between the instantaneous rotational position of the chair 5 and the desired position (upright, i.e. horizontal seat 6). For this absolute-orientation sensor 140, accuracy is more important than speed.

The signal S(ψ) from the absolute-orientation sensor 140 is provided as input signal to the second control member 102. The second control member 102 generates the command signal C for the first control member partly on the basis of the input signal S(ψ) received, in such a manner that θ is changed to render ψ substantially equal to zero. The effect thus achieved is that the chair 5 is kept upright in space at all times.

As the operation and construction of the absolute-orientation sensor 140 do not constitute a subject of the present invention, and any knowledge thereof is not required for a proper understanding of the present invention, this sensor will not be further discussed. It suffices to observe that such sensors are known per se, for instance in the form of a gravitational direction sensor, and that such known sensors can be utilized.

The horizontal-keeping system 100 proposed by the present invention is thus capable, with a high degree of certainty, to keep the chair 5 upright at all times, regardless of the position of the carriage 3, while speed and accuracy are combined. During normal use, a changing position of the carriage 3 will rapidly be detected on the basis of the signal S(ϕ), and the position of the chair 5 relative to the carriage 3 is promptly adjusted to compensate for the changed position of the carriage 3. For an accurate control of the position of the chair 5 in absolute sense, the signal S(ψ) is used. With this signal, drift, if any, of the sensor 130 is compensated for as well.

Preferably, the second control member 102 comprises two alarm outputs 103 and 104, and at those alarm outputs 103 and 104, the second control member 102 provides the alarm signal S(alarm1) and S(alarm2) if the control member 102 detects specific predefined fault conditions. By way of example, the second control member 102 may be arranged to compare the signal S(ψ) with a first reference value representative of a first critical angle, and to generate at the first alarm output 103 the first alarm signal S(alarm1) if it is detected that the absolute value of ψ exceeds the first critical angle. That first critical angle may for instance be 5°. The first alarm signal S(alarm1) is supplied to a control circuit, not shown for simplicity's sake, for the drive means of the carriage 3, to hold the carriage 3 still as long as this situation lasts. Such a situation could for instance present itself if it cannot keep pace with a quick change of the position of the carriage 3; by holding the carriage still in that case, the horizontal-keeping system 100 is enabled to "catch up" with this quick change.

The second control member 102 may be arranged to compare the signal S(ψ) with a second reference value representative of a second critical angle which is less than the first critical angle, and to remove the first alarm signal S(alarm1) if it is detected that the absolute value of ψ falls below that second critical angle. That second critical angle may for instance be 2°.

Under normal conditions, the fault angle of the chair 5 is usually less than 5°. If, for whatever reason, the control system of the horizontal-keeping system 100 fails, it could happen that the chair 5 assumes such an oblique position that a user falls from the chair. It will be understood that such a situation must be avoided. Therefore, the system 100 is preferably arranged so that if the fault angle rises above a predetermined third critical angle, all electric excitation is switched off, i.e. the carriage 3 and the chair 5 are fixed. This third critical angle may for instance be 10°. To that end, the second control member 102 may be arranged for comparing the signal S(ψ) with a third reference value representative of the third critical angle, and for generating the first alarm signal S(alarm1) at the first alarm output 103 and for generating the second alarm signal S(alarm2) at the second alarm output 104 if it is detected that the absolute value of ψ exceeds the third critical angle. The second alarm signal S(alarm2) is supplied to the control circuit for the chair motor 12 to also hold the chair 5 still as long as this situation lasts. Optionally, a sound signal may also be generated with the second alarm signal S(alarm2) for calling for help.

The above-described horizontal-keeping mechanism 100 is secured against failure of the orientation sensor 130, in the sense that faulty measuring signals S(ϕ) cannot lead to an unacceptable fault position of the chair, because the absolute position of the chair 5 is detected by the absolute-orientation sensor 140, enabling a correction. Conversely, a faulty measuring signal S(ψ) from the absolute-orientation sensor 140 cannot be detected and/or corrected by the orientation sensor 130. To secure the horizontal-keeping mechanism 100 against failure of the absolute-orientation sensor 140 as well, the chair 5 preferably comprises a second absolute-orientation sensor 150, whose operation may be identical to that of the first absolute-orientation sensor 140. The signal provided by the second absolute-orientation sensor 150 is indicated as S'(ψ).

The second control member 102 is arranged to compare the two measuring signals S(ψ) and S'(ψ) with each other, and to generate the first alarm signal S(alarm1) at the first alarm output 103 and to generate the second alarm signal S(alarm2) at the second alarm output 104 if it is detected that the difference between the two signals is more than a predetermined threshold value, for instance 2°. As it is not possible to determine, on the basis of the data received, which of the signals received is correct and which is faulty, the entire system should be stopped, in view of safety.

Preferably, the first sensor 140 and the second sensor 150 are mutually different types. This reduces the probability that, if a specific failure occurs in one of those sensors, a comparable failure occurs in the other sensor.

It will be readily understood by anyone skilled in the art that the protective scope of the present invention as defined by the claims is not limited to the embodiments shown in the drawings and discussed, but that it is possible to alter or modify the embodiments shown of the stairlift according to the invention within the framework of the inventive concept. For instance, it is possible that the two control members 101 and 102 are combined into a single control member.

Further, it is possible that the orientation sensor 130 provides a signal S(∂ϕ/∂ψt) indicative of the time derivative of the angle ϕ, and that the second control member 102 generates the command signal C for the first control member on the basis of the input signal S(∂ϕ/∂ψt) received.

What is claimed is:

1. A lift (1) comprising:

a carriage (3) which is displaceable along a path (2) of which a projection on a vertical plane contains at least one bend (24, 25);

a drive mechanism having a drive motor for displacing the carriage (3) along said path (2);

an object (5) carried by said carriage (3) and mounted on said carriage (3) for tilting about a substantially horizontal axis of rotation (11);

a horizontal-keeping mechanism (100) for holding the object (5) in a predetermined position relative to vertical (V), said horizontal-keeping mechanism comprising:

a rotation mechanism (10), driven by a motor (12), for causing said object (5) to tilt relative to said carriage (3);

control members (101, 102) for said motor (12);

an angle sensor (110) coupled to the control members (101, 102) and providing a signal (S(θ)) indicative of an instantaneous value of an angle of rotation (θ) between the object (5) and the carriage (3);

an orientation sensor (130) coupled to the control members (101, 102) and associated with the carriage (3), providing a signal (S(ϕ); S(∂ϕ/∂t)) indicative of variations in the position (ϕ) of the carriage (3) in respect of said axis of rotation (11) relative to the vertical (V);

wherein the control members (101, 102) are arranged to drive the motor (12) so that said angle of rotation (θ) is changed to an equal extent but opposite to the variations in the position (ϕ) of the carriage (3) detected by the orientation sensor (130).

2. A lift according to claim 1, wherein the horizontal-keeping mechanism (100) comprises an absolute-orientation sensor (140) coupled to the control members (101, 102) and associated with the object (5), providing a signal (S(ψ)) representative of the instantaneous value of the position (ψ) of the object (5) in respect of said axis of rotation (11) relative to the vertical (V); and wherein the control members (101, 102) are arranged to drive the motor (12) based on the received signals (S(ϕ), S(ψ)) in such a manner that said position (ψ) of the object (5) is held substantially equal to a desired position.

3. A lift according to claim 1, wherein the control members (101, 102) are arranged to generate a first alarm signal (S(alram1)) if it is detected that said position (ψ) of the object (5) exceeds a predetermined first critical angle.

4. A lift according to claim 3, wherein the control members (101, 102) are arranged to remove the first alarm signal (S(alarm1)) if it is detected that said position (ψ) of the object (5) falls below a predetermined second critical angle, smaller than the first critical angle.

5. A lift according to claim 3, wherein the control members (101, 102) are coupled to said drive mechanism of the carriage (3) to prevent, displacement of the carriage (3) as long as said first alarm signal (S(alarm1)) is being generated.

6. A lift according to claim 3, wherein the control members (101, 102) are arranged to fix the carriage (3) and the object (5) if it is detected that said position (ψ) of the object (5) exceeds a predetermined third critical angle.

7. A lift according to claim 2, wherein the horizontal-keeping mechanism (100) comprises a second absolute-orientation sensor (150) coupled to the control members (101, 102) and associated with the object (5), providing a second signal (S'(ψ)) representative of the instantaneous value of the position (ψ) of the object (5) in respect of said axis of rotation (11) relative to the vertical (V);

wherein the control members (101, 102) are arranged to compare the two signals (S(ψ) and S' (ψ)) with each other; and wherein the control members (101, 102) are arranged to fix the carriage (3) and the chair (5) if it is detected that a difference between said two signals (S(ψ) and S' (ψ)), exceeds a predetermined threshold value.

8. A lift according to claim 7, wherein the two absolute-orientation sensors (104, 150) are of mutually different types.

* * * * *